United States Patent [19]

Saeva et al.

[11] 4,089,684

[45] May 16, 1978

[54] IMAGING METHOD UTILIZING THE CHEMICAL REACTIVITY OF DONOR-ACCEPTOR MIXTURES

[75] Inventors: Franklin D. Saeva; George R. Olin, both of Webster; William W. Limburg, Penfield, all of N.Y.

[73] Assignee: Xerox Corporation, Stamford, Conn.

[21] Appl. No.: 763,782

[22] Filed: Jan. 31, 1977

[51] Int. Cl.[2] ..... G03G 13/00; G03G 13/22

[52] U.S. Cl. ..... 96/1.1; 96/1 R; 96/1 E; 96/1.5 R; 96/88; 96/89

[58] Field of Search ..... 96/1 R, 1.1, 1 E, 1.5

[56] References Cited

U.S. PATENT DOCUMENTS

| | | | |
|---|---|---|---|
| 3,287,118 | 11/1966 | Hoegl | 96/1.5 |
| 3,408,181 | 10/1968 | Mammino | 96/1.1 |
| 3,512,966 | 5/1970 | Shattuck et al. | 96/1 R |
| 3,677,750 | 7/1972 | Mammino et al. | 96/1.1 X |
| 3,681,066 | 8/1972 | McGuckin | 96/1 R |
| 3,764,311 | 10/1973 | Bean | 96/1.1 |
| 3,879,197 | 4/1975 | Bartlett et al. | 96/1 R X |
| 3,879,201 | 4/1975 | Williams et al. | 96/1.5 X |

*Primary Examiner*—Roland E. Martin, Jr.

[57] ABSTRACT

Disclosed is an imaging method based upon the selective exposure of a select pair of photoactive materials to actinic radiation. According to this method, charge exchange between materials of a photosensitive mixture results in the selective decomposition of one of the components of said mixture. In the event that the above materials are dispersed within a polymeric film, the selective decomposition of one of these dispersed components will be manifest by changes induced in the polymeric film. Such changes in the characteristic properties of the film will, of course, vary depending upon the content of the dispersed photosensitive components in the film and the extent of decomposition of one of said materials.

2 Claims, No Drawings

IMAGING METHOD UTILIZING THE CHEMICAL REACTIVITY OF DONOR-ACCEPTOR MIXTURES

BACKGROUND OF THE INVENTION

1. Field of the Invention

This invention relates to an imaging method based upon the chemical reactivity of a select pair of photoactive materials. More specifically, this invention concerns itself with a method for image creation based upon the photoinduced oxidative or reductive degradation of one of the above select materials. Dispersal of these materials in a polymeric film and the subsequent selective photoinduced decomposition of one of said materials will induce certain changes within the polymeric film thereby altering the films optical and/or physiochemical properties in those regions corresponding to such decomposition.

2. Description of the Prior Art

The use of organic compounds as photosensitive medium for photographic processes is well known and is perhaps best exemplified by the diazo process. This process is based upon the photochemical changes effected in various diazonium salts upon exposure to activating energy thereby altering the capacity of such salts to form dyes. In general, dyes are formed when such diazonium compounds or a diazotized amine couple with phenols or aromatic amines in an alkaline medium. Upon exposure to light, diazonium compounds undergo decomposition and are thus rendered incapable of coupling and thereby dye formation is precluded. This type of photolytic degradation of diazonium compounds is commonly employed in copying papers. For example, in one such copy paper based process, a diazo anhydride and a coupler are dispersed in a neutral medium, the paper exposed to activating energy of the appropriate wavelength and thereafter developed by contacting with ammonia fumes. In another analogous process, the paper which is coated with a diazo compound is developed by immersion in alkaline solution containing the dye coupler.

The photolytic degradation products of diazonium compounds can also be used as reducing agents in the conversion of the leuco form of certain phthalocyanine compounds to higherly colored materials, see U.S. Pat. No. 2,884,326. In this system, the leuco form of phthalocyanine and a diazonium compound are dispersed in a water permeable colloid and the resultant dispersion coated as a film on a supportive substrate. After this film has dried, it is exposed to activating electromagnetic radiation and thereafter the film is treated with a solvent capable of dissolving the leuco form of phthalocyanine compounds. Alternatively, the exposed film can be treated with a solution of strong acid. In either event, a positive image is produced within the coating by conversion of the leuco form of phthalocyanine to its highly colored counterpart.

In each of the systems described hereinabove, image formation is based upon the selective decomposition of a diazonium compound either to render it incapable of coupling with other materials or to assist in conversion of a colorless compound to its highly colored counterpart.

Photolytic degradation processes have also been used in the preparation of relief images from certain photodegradeable polymers, see for example, U.S. Pat. No. 3,558,311; and 2,892,712 (examples VII and IX). In the above patented processes, selective illumination of an imaging layer containing a degradeable polymer results in its degradation into lower molecular weight material. The products of such degradation differ from the non-degraded polymer and thereby provides a basis for image formation. In the 3,558,311 patent, the selective illumination of a polymer containing an oxime ester results in the degradation of this material in the exposed regions of the film wherein this ester is present. The image is "developed" by removal of the degraded material from the imaging layer with solvents which are specific for the degradation products but non-solvents for the materials in the exposed regions of the imaging layer. The '711 patent is similar in its disclosure, however, subsequent to imaging of the film, the light destabilized formaldahyde polymer is "developed thermally". In both of the polymer based imaging systems referred to hereinabove, the intensity and duration of exposure required to produce photolytic degradation within such films is quite extensive. Moreover, even after such intensive exposure to imaging energies, the image is still not visible, but requires additional development either with solvents or by thermal treatment. These systems are, thus, inefficient, expensive and generally impractical for commercial use.

Recently a number of patents have issued which reportedly enhance the selective degradation of polymers, such as poly(acetaldehyde). Such enhancement in degradation is achieved through the combination of the poly(acetaldehyde) with a variety of other materials; such as polymers capable of undergoing dehydrohalogenation and/or a variety of sensitizer materials which are photoactivated and thereby initiate breakdown of the degradable polymer. These patents are as follows: U.S. Pat. Nos. 3,915,704; 3,915,706; 3,917,483; 3,930,858; 3,951,658; 3,963,491; and 3,964,707.

Notwithstanding the advances made in the art which are reported in the above patents, further refinement is still required; especially in adapting these improved systems for use with both visible light and laser input. In the absence of compatibility of the above prior art systems with laser input, it is not as yet possible to prepare high resolution vesicular images from direct irradiation with highly colliminated light without additional development and/or intensification of the latent image with thermal energy.

Accordingly, it is the object of this invention to remedy the above as well as related efficiencies in the prior art.

More specifically, it is the object of this invention to provide an imaging method utilizing the chemical reactivity of photoexcited states of certain select materials.

Another object of this invention is to provide an imaging method wherein image creation is based upon photoactivation of either component of the pair of select materials thereby resulting in the decomposition of the less chemically stable component of the pair of select materials.

Additional objects of this invention include the preparation and use of imaging members based upon the above photoactive chemical decomposition processes.

SUMMARY OF THE INVENTION

The above and related objects are achieved by providing an imaging method based upon photoinitiated, chemical decomposition of either an electron donor or an electron acceptor compound of a photosenstive mixture within a polymeric film. Upon photexcitation of either one or both of the electron donor or the electron acceptor compounds of this mixture, the film will undergo certain changes in its physical, chemical and/or electrical properties. Such changes are manifest only in those areas where decomposition of one of the photosensitive components has occurred.

As will be readily apparent, certain combinations of electron donor and electron acceptor compounds may have overlapping absorption spectra. It is, therefore, full contemplated that irradiation of the imaging member with activating electromagnetic radiation can cause both the donor and acceptor compounds of the photosensitive mixture to be elevated to their excited states. It is, therefore, a further requirement of this imaging method, that of the materials specifically selected for a particular photosensitive mixture, only one of the materials of the combination will retain its chemical stability upon the release or acceptance of an electron and the other material of the combination will become chemically unstable upon acceptance or release of an electron. The capability of the materials of the photosensitive mixture to accept or release an electron is determined by their ionization potential and electron affinity relative to one another.

In a typical imaging method of this invention, an electron acceptor compound can be photoactivated by selective exposure to activating electromagnetic radiation thereby causing said acceptor compound to undergo an electronic transition from the ground to the excited state. Electron transfer to the photoexcited species of electron acceptor from a relatively chemically unstable electron donor component of the photosensitive mixture results in the decomposition of the latter. The following series of reactions illustrate this interaction between the various components of the photosensitive mixture:

(photoactivation of acceptor compound) $A \overset{by}{} A^*$ (electron transfer) $A^* + D \rightarrow (A \cdots D)^* \rightarrow A^- + D_+$ (degradation of donor compound) $D^{\cdot\pm} \rightarrow CO_2 + R^{\cdot} + H^+$ (radical coupling process) $2\,R^{\cdot} \rightarrow R - R$ Similarly, decomposition of an electron acceptor component of a photosenstive composition can be initiated by activation of the electron donor compounds with electromagnetic radiation of the appropriate wavelength. In addition, energy transfer sensitizers, pigments and/or dyes can also be included within the photosensitive composition to tailor the photoresponsiveness of the system to a particular light source.

DESCRIPTION OF THE INVENTION INCLUDING PREFERRED EMBODIMENTS

Recording media useful in the imaging method of this invention can be prepared by simply dissolving a photosensitive mixture of electron donor and electron acceptor compounds together with a polymeric resin in a common solvent, followed thereafter by casting or coating the resultant solution/dispersion as a continuous film on a supportive substrate. Film thickness is not believed to be critical to the imaging method of this invention and typically such films can range in thickness from 0.1 micron to about 250 microns. The amount of photosensitive materials present in the resultant film is not critical and good results can be achieved with as little as 1 percent by weight of photosensitive mixture in the film.

The polymeric resin suitable for use in preparation of recording media for the imaging method of this invention can comprise virtually any naturally occuring or synthetic resin provided such polymers are substantially non-absorbing of the activating electromagnetic radiation needed to induce decomposition of one of the components of the photosenstive mixture. The polymeric resin suitable for use in such recording media can either be thermoplastic or thermosetting. Of course, the type of resin selected for use in such recording media will, in certain instances, restrict the methods available for intensification and/or development of the image information imparted to the recording media. Polymeric resin suitable for use in preparation of such recording media include nylons, polyesters, polycarbonates, phenolics, acrylates, vinyls and natural and snythetic rubbers; of course, the common organic solvent soluble polymers are preferred for their ease of fabrication.

The photosensitive mixture which is dispersed within the polymeric resin in preparation of the recording media, can typically include any non-polymeric, cyclic, polycyclic or heterocyclic compound (and their corresponding salts) capable of absorption of electromagnetic radiation and undergoing an electronic transition from the ground to the excited state. Such compounds generally are classified as electron donor materials or electron acceptor materials depending upon their relative propensity to release or accept electrons. In the context of this invention, such characterization is used as a matter of convenience and need not necessarily refleft the functional role of these materials in the generation of an image within the recording media.

The concentration of the photosensitive mixture in the polymeric resin is directly related to the type of physical changes which are induced in this film. As a general practice it is preferable to maintain the concentration of such mixture in the film at a level which is insufficient to result in phase separation of these materials from the resin. This saturation point will differ depending upon the particular components of the photosensitive mixture and relative solubility thereof in a particular resin. Good results can be achieved with recording media having as little as 1 percent by weight of the photosensitive mixture dispersed within the polymeric resin.

In a typical embodiment of this invention, the relative mole ratio of donor to acceptor can range from about 10:1 to about 1:10, however, it is generally preferable that equimolar amounts of each of the components of the photosensitive mixture be present in the polymeric film. The relative concentration of electron donor to electron acceptor compounds in the photosensitive mixture is generally independent of other optional components also present therein. Electron donor materials which can be used in the photosensitive mixture include 4-methoxyphenyl acetic acid, 3-methoxyphenyl acetic acid, t-butyl-3,4-dimethoxyphenyl acetate, p-nitroxybenzyl carboxylate, 3-methoxyphenyl acetic acid, 3,4-di-methoxyphenyl acetic acid, and 1,1′-diethyl-2,2′-cyanine.

Electron acceptor materials which can be used in the photosensitive mixture include triphenyl;pyrylium fluoroborate, tri-p-tolylpyrylium fluoroborate, tri-p-tolylthiapyrylium fluorolorate, tri-p-tolylpyyrlium chloride, 9-cyanoanthracene, 1-tert-butylanthraquinone, 1-cyanonaphthalene and 5,8-dicyanonaphthyl carbinyl-p-nitrophenyl carbonate.

It is both critical and essential to the selection of a specific combination of donor and acceptor compound for the photosensitive mixture, that either one, and only one, of said compounds of the combination undergo irreversible electrochemical oxidation (electron donor compounds) or irreversible electrochemical reduction (electron acceptor compounds). Such irreversible electrochemical reaction causes the chemical destabilization of the compound thereby resulting in its decomposition.

In order to determine which compounds exhibit a tendency toward such irreversible electrochemical destabilization, routine materials screening of compounds suspected of such instability can be performed by standard cyclic voltammetry techniques. Apparatus and procedures involved in cyclic voltammetric analysis are desired in the technical literature, e.g. C. K. Mann and K. K. Barnes, *Electrochemical Reaction In Nonaqueous Systems,* Marcel Dekker, Inc., New York, New York, pp. 9–11 (1970).

The individual components of the photosensitive mixture can be selected from any combination of materials listed hereinabove, provided, that the thermodynamics of electron transfer preclude such transfer (and catalysis of decomposition of the photosensitive composition) in the absence of imaging energies. The use of the Weller equation allows one to predict which of the above donor and acceptor compounds can be paired with one another consistent with the objectives of this invention, H. Leonhardt and A. Weller, *Ber Bunsengesellschaft Phys. Chem.,* Vol. 67, page 791 (1963); D. Rhem and A. Weller, ibid, Vol. 73, page 834 (1969), H. Knibbe, D. Rehm and A. Weller, ibid, page 839; and D. Rehm and A. Weller *Z. Phys. Chem.* (Frankfurt), Vol. 69, page 183 (1970). It is also preferable that the materials selected for use in recording media be substantially incapable of forming an intermolecular charge transfer complex with one another or with the polymeric resin used in fabrication of the recording media. Of course, such intermolecular charge transfer complex formation is permissible in those instances where it does not involve electron transfer from the electron donor to the electron acceptor molecule in the ground state. The reasons for such preference is the avoidance of creation of background which can potentially detract from the quality of the image created within or subsequently developed on the recording media.

The photosensitive mixture, as indicated previously, can also contain certain sensitizer materials for the purpose of enhancing the efficiency of absorption of image information or for the purpose of shifting the absorption characteristics of the film so as to render it more compatible for use with a particular light source. Such sensitizer materials can include conventional dye stuffs or dye stuffs which undergo fluorescence upon absorption of imaging energies. In addition, the film containing the photosensitive mixture can be sensitized externally by being placed in a contiguous relationship with a layer of photoconductive materials.

Once having fabricated the recording media suitable for use in the imaging method of this invention, image information can be projected thereon by any one of a variety of well known techniques. Such techniques include contact printing through a transparency, standard projection exposure and laser scan recording. As indicated previously, the extent of degradation upon the relative concentration of the photosensitive mixture within the polymeric film and the intensity of exposure to image information.

In the preferred embodiments of this invention, the amount of photosensitive mixture in the recording media is generally in the range of from about 25 to about 50 weight percent. Higher concentrations can also be used provided that extensive phase separation between the photosensitive mixture and polymeric resin does not occur. Recording medium having a content of photosensitive materials within the previously stated range generally will produce highly visible images upon exposure to image input of the appropriate wavelength and intensity. In the event that the content of photosensitive mixture in the recording medium is toward the low end of the previously stated range, the image may be only slightly visible or may not be visible at all. In the event that sufficient degradation has not occurred to create visible changes in the recording media, a latent image will nevertheless be recorded within such media (the intensity thereof being dependent upon the extent that degradation of the photosensitive mixture). Even though the image recorded within recording medium does not manifest itself by inducing perceptable changes in the polymer, a variety of changes in the properties of polymeric resin of the recording media are, in fact, effected. These changes can be readily recorded by conventional image intensification and/or development techniques. The relative differences in physical, chemical and/or electrical properties between those areas of the recording media corresponding to degradation of a component of the photosensitive mixture and those areas of the recording media in which no degradation takes place, form the basis for all of the various imaging methods contemplated within the scope of this invention.

Representative of some of the property differences induced by molecular changes within the polymeric film, resulting from such decomposition, which can be used in both latent and visible image generation, include: spectral absorption, light refraction, dipole moment, molar volume, solubility crystal form, absorption, contact angle, surface energy, melting point, viscosity, conductivity, chemical reactivity, photoconductivity and triboelectric properties.

Where imge formation (visible or latent) does not permanently transform or alter the recording medium, the recording medium can be reused in formation and development of subsequent images thereby providing the capability of adding on additional image information.

The examples which follow further define, describe and illustrate the various techniques used in preparation of the recording media used in the imaging methods of this invention. In addition, these examples illustrate the various types of image intensitification and development systems compatible with such recording media. The techniques and equipment used in both the preparation and evaluation of such recording media are standard or as hereinbefore described. Parts and percentages appearing in such examples are by weight unless otherwise indicated.

EXAMPLE I

Polystyrene (1.0 gram), tri-p-tolylpyrylium fluoroborate (0.1 gram) and 4-methoxyphenyl acetic acid (0.1 gram) are dissolved in two milliliters of methylene chloride. The resultant solution is coated on a clear glass slide with a doctor blade having a wet gap setting of 3 mils. The coated slide is allowed to dry until substantially all of the coating solvent has evaporated. Care is taken during both the coating and drying procedures to shield the photosensitive coating from light of a wavelength below 500nm. The photosensitive coating is now selectively expos to activating electromagnetic radiation by placing a transparency in contact with the coating and exposing said coating through the transparency to 1000 Watt mercury/xenon lamp equipped with 436nm interference filter. The distance from the lamp to the slide is approximately 10 inches and the duration of exposure approximately 100 seconds.

Upon cessation of exposure, a highly visible image, corresponding to the information in the transparency, is recorded on the slide.

The procedures of Example I are repeated except for the following changes in composition of the slide coating and process conditions.

EXAMPLE II

| | Coating Composition | Interference Filter |
|---|---|---|
| (a) | polymer - polystyrene | 400nm |
| (b) | photosensitive mixture - 2-t-butylanthraquinone; 3-methoxyphenyl acetic acid | |

Result - highly visible image without separate development being required.

EXAMPLE III

| | Coating Composition | Interference Filter |
|---|---|---|
| (a) | polymer - methylmethacrylate | 450nm |
| (b) | photosensitive mixture - tri-p-tolylthiapyrylium fluoroborate; t-butyl-3,4-dimethoxyphenyl acetate | |

Result - highly visible image without separate development being required.

EXAMPLE IV

| | Coating Composition | Interference Filter |
|---|---|---|
| (a) | polymer - polystyrene | 436nm |
| (b) | photosensitive ingredient - tri-p-tolylpyrylium-p-methoxybenzyl carboxylate | |

Result - highly visible image without separate development being required.

EXAMPLE V

The procedure of Example I is repeated with a series of identically prepared slides except that the exposure of the photosensitive mixture to activating electromagnetic radiation is insufficient to effect visible changes in the slide coating (exposure interval in the range of from about 40 to 60 seconds). A field is established across the slide by placing the uncoated side in contact with a ground metal plate while corona charging the free surface of the photosensitive coating to a positive potential of about 400 volts. The coating is therefore heated with an infrared lamp resulting in the appearance of a frosted image thereon.

EXAMPLE VI

The procedure of Example V is repeated except for the development of the latent image with a negatively charged toner composition comprising a copolymer of n-butylmethacrylate and polystyrene.

EXAMPLE VII

The procedure of Example I is repeated except that prior to latent image formation the surface of the coating is uniformly frosted. Latent image formation is effected by exposure of the photosensitive composition through the uncoated surface of the glass substrate. Following latent image formation, the frosted surface of the photosensitive coating is exposed methylene chloride vapors for an interval sufficient to cause the unexposed surface of the coating to revert to its former specular condition.

EXAMPLE VIII

The procedure of Example I is repeated except that following latent image formation the surface of the coating is heated to a point just above the glass transition temperature (Tg = 100° C) of the polystyrene. Such heating renders the surface of the coating adhesive in imagewise configuration. This adhesive image is contacted with a donor member having toner particle loosely adherent thereto. Following separation of the donor member and the adhesive image, a portion of the toner is retained by the adhesive portion of the coating thus forming a visible image.

What is claimed is:

1. An imaging method based upon a photoinitiated chemical degradation reaction of a component of a photosensitive mixture within a polymeric film, said photosensitive mixture containing a non-polymeric electron donor material and a non-polymeric electron acceptor material, the method comprising:

(a) providing a film of polymeric material containing at least about 1 percent by weight of a mixture which includes a non-polymeric electron donor compound and a non-polymeric electron acceptor compound, the relative mole ratio of donor the acceptor compounds in said mixture being in the range of from about 10:1 to about 1:10, and the electron releasing propensity of the donor compound relative to the electron withdrawing propensity of the electron acceptor compound tending to preclude electron transfer therebetween in the absence of illumination with activating electromagnetic radiation;

(b) forming a latent image within said film by selectively exposing the mixture to sufficient activating electromagnetic radiation to cause at least one of said electron donor compounds and said electron acceptor compounds of the mixture to undergo an electronic transition from the ground to the excited state, whereby one of said compounds undergoes an irreversible electrochemical reaction as a result of charge transfer incident to such electronic transition, said irreversible electrochemical reaction resulting in the decomposition of the compound of the mixture undergoing said reaction, thereby inducing within said selectively exposed areas of the film modifications in the film's properties; and (c) rendering said latent image visible by creating a field across said film followed by heating said film to or slightly above its glass transition temperature whereby the exposed areas of the film take on a frosted appearance.

2. An imaging method based upon a photoinitiated chemical degradation reaction of a component of a photosensitive mixture within a polymeric film, said photosensitive mixture containing a non-polymeric electron donor material and a non-polymeric electron acceptor material, the method comprising:

(a) providing a film of polymeric material containing at least about 1 percent by weight of a mixture which includes a non-polymeric electron donor compound and a non-polymeric electron acceptor compound, the relative mole ratio of donor to acceptor compounds in said mixture being in the range of from about 10:1 to about 1:10, and the electron releasing propensity of the donor compound relative to the electron withdrawing propensity of the electron acceptor compound tending to preclude electron transfer therebetween in the absence of illumination with activating electromagnetic radiation;

(b) forming a latent image within said film by selectively exposing the mixture to sufficient activating electromagnetic radiation to cause at least one of said electron donor compounds and said electron acceptor compounds of the mixture to undergo an electronic transition from the ground to the excited state, whereby one of said compounds undergoes an irreversible electrochemical reaction as a result of charge transfer incident to such electronic transition, said irreversible electrochemical reaction resulting in the decomposition of the compound of the mixture undergoing said reaction, thereby inducing within said selectively exposed areas of the film modifications in the film's properties; and (c) rendering said latent image visible by creating a field across said film followed by contacting the charged surface of said film with a charged colored powder, the relative polarity of the surface charge on the film and the charge on the powder causing attraction of said powder to those areas of the film capable of retention of the surface charge.

* * * * *